United States Patent [19]

Januschkowetz et al.

[11] 4,036,707

[45] July 19, 1977

[54] METHOD FOR METALLIZING THERMOSETTING PLASTICS

[75] Inventors: Herbert Januschkowetz, Neukatzwang; Hans Laub, Nurnberg, both of Germany

[73] Assignee: Siemens Aktiengesellschaft, Munich, Germany

[21] Appl. No.: 715,722

[22] Filed: Aug. 19, 1976

[30] Foreign Application Priority Data

Aug. 29, 1975 Germany ..... 2538571

[51] Int. Cl.[2] ..... C25D 5/10; C25D 5/56; C25D 5/54

[52] U.S. Cl. ..... 204/20; 204/30; 427/306; 427/307

[58] Field of Search ..... 204/20, 30; 427/305, 427/307, 304, 301, 306

[56] References Cited

U.S. PATENT DOCUMENTS

| | | | |
|---|---|---|---|
| 3,437,507 | 4/1969 | Jensen | 427/306 |
| 3,567,594 | 3/1971 | Wells | 204/20 |
| 3,664,860 | 5/1972 | Kamiya et al. | 427/305 |
| 3,808,028 | 4/1974 | Lando | 427/306 |
| 3,902,974 | 9/1975 | Bava | 204/20 |

*Primary Examiner*—T. M. Tufariello

*Attorney, Agent, or Firm*—Kenyon & Kenyon, Reilly, Carr & Chapin

[57] ABSTRACT

A method for metallizing a thermosetting resin is provided comprising:

a. etching the surface of said resin with an oxidizing acid;
b. activating the surface of said resin with a stannous chloride solution;
c. sensitizing said resin in an aqueous solution of from 0.1 to 0.5 g per liter of palladium chloride and 1 to 6 ml of concentrated hydrochloric acid per liter;
d. immersing said resin at about 90° C in an accelerator bath having a pH of about 7, said bath containing sodium hypophosphite, trisodium citrate, ammonium chloride and 2,4-dihydroxy benzoic acid;
e. electrolessly nickel-plating said resin at a temperature of between about 96° to 99° C in a fast-depositing nickel bath having a pH of about 6.5 to 6.9 to form a nickel layer;
f. electroplating said nickel layer with copper; and
g. metallizing said copper layer to form a metallized layer.

The deposited metal coatings are particularly strongly adhering, abrasion and wear-proof and particularly well suited for metallizing type carriers for teleprinters.

14 Claims, No Drawings

METHOD FOR METALLIZING THERMOSETTING PLASTICS

BACKGROUND OF THE INVENTION

The metallizing of thermoplastics, particularly of copolymers of acrylonitrile, butadiene and styrene is known. It is based on micro-roughening the plastic surface by an etching solution, seeding with a metal such as silver or palladium, whereby activation and sensitizing is brought about, electroless metal deposition (without current) of, for instance, copper or nickel and finally, electroplating according to conventional methods, copper usually being deposited as the first layer. As example of such known methods are found in the variants of the Noviganth process.

However, the electroplating of thermosetting plastics is technically difficult. Mechanical roughening methods are usually complicated and often, no fast-adhering metallization is obtained. It is known that thermosetting plastics can be chemically etched, particularly by an oxidizing attack. Subsequent metallizing as with thermoplastics is also possible. Chromic-sulfuric acid solutions are particularly well suited for roughening thermosetting plastics, particularly phenolic resins and unsaturated polyester resins. This method, while permitting the metallizing of thermosetting plastics, especially phenolic resin moldings, does not produce coatings that adhere sufficiently strongly for many applications. This manifests itself particularly in the case of hard chromium plating. As is well known, hard chromium films exhibit internal stresses. Metal combinations, e.g. copper-nickel-chromium on phenolic resin, tear away during the hard chromium plating, which is probably the result of insufficient adhesion.

SUMMARY OF THE INVENTION

It is an object of the present invention to provide a method for metallizing, which ensures good adhesion of the coating on the thermosetting plastic, and high wear resistance of the final layer. If the method according to the invention is applied, for instance, to type carriers for teleprinters (large number of impacts, high impact frequency), the final layer can particularly withstand the high mechanical stress during an impact.

This problem is solved by a process which comprises:

a. etching the surface of said resin with an oxidizing acid;
b. activating the surface of said resin with a stannous chloride solution;
c. sensitizing said resin in an aqueous solution of from 0.1 to 0.5 g per liter of palladium chloride and 1 to 6 ml of concentrated hydrochloric acid per liter;
d. immersing said resin at about 90° C in an accelerator bath having a pH of about 7, said bath containing sodium hypophosphite, trisodium citrate, ammonium chloride and 2,4-dihydroxy benzoic acid;
e. electrolessly nickel-plating said resin at a temperature of between about 96° to 99° C in a fast-depositing nickel bath having a pH of about 6.5 to 6.9 to form a nickel layer;
f. electroplating said nickel layer with copper; and
g. metallizing said copper layer to form a metallized layer.

The process further comprises, if desired, chrome-plating after metallizing. Nickel-plating, tin-plating, or silver-plating have been found to be particularly advantageous metallizations.

By etching in an oxidizing acid, e.g., in chromic-sulfuric acid, fuming nitric acid or fuming sulfuric acid, the thermosetting plastic surface is optimally roughened; depressions and cavities being produced in the surface in which the electroless deposited and the first electrodeposited metal layers are embedded, whereby good adhesion is obtained. Through the immersion in the accelerator solution, which follows the activation and sensitizing, a rapid and uniform growth of the electroless-generated nickel layer is surprisingly achieved. A further important advantage is obtained in the use of a fast-depositing bath for the electroless nickel plating. As particularly advantageous have been found the baths according to German Pat. No. 2,253,491. Starting from the finely distributed palladium metal seeds, a dense, closed nickel layer is produced in a short time due to the rapid precipitation. The metal coating electroplated thereon exhibit considerably better adhesion than if a slower-depositing bath is used for the electroless nickel-plating.

The electroplated copper layer, which can be deposited on the electroless-produced nickel coating in a bright acid copper bath with a thickness of 15 to 20 μm constitutes a uniform, smooth, soft intermediate layer, which serves as a base for further electroplating and as a damping substrate between the thermosetting plastic and the hard, electroless-generated nickel layer. A nickel layer which is electroplated from a nickel bath, particularly a bright nickel bath subsequent to a copper coating can readily be chrome-plated. The chromium layer is preferably applied with a thickness of 10 to 15 μm.

In many cases, e.g., for a type carrier of thermosetting plastic material, hard chrome-plating with a minimum layer thickness of 5 μm has been found to be particularly advantageous. Sufficiently abrasion-resistant surfaces are obtained with the small layer thickness mentioned. The hard chromium layer does not tear off, however, even with layer thickness of up to 10 to 15 μm.

DESCRIPTION OF THE PREFERRED EMBODIMENTS

To carry out the method of the invention, the etching is preferably performed in a chromic-sulfuric acid solution. This causes the subsequently deposited metal coating to be anchored well in the plastic. The etching time in the chromic-sulfuric acid solution is 4 to 5 minutes for phenolic resin moldings at 80° C.

It is particularly advantageous to perform the sensitizing in a palladium chloride solution which contains 0.2 g/l palladium chloride and 3 ml concentrated hydrochloric acid per liter. The sensitizing time is 0.5 to 3 minutes and preferably 1 minute.

In an accelerator solution containing 70 g/l of sodium hypophosphite, 25 g/l trisodium citrate, 25 g/l ammonium chloride and 1 g/l 2,4-dihydroxy benzoic acid at a pH of 7, the immersion time is 2 to 3 minutes.

Particularly advantageous are fast-depositing baths of nickel salt, complex salt and sodium hypophosphite according to the German Offenlegungsschrift No. 2,253,491, which contains an addition of 0.1 to 5 g/l of a water-soluble polyhydroxy benzene and optionally, as a stabilizing agent, 0.002 to 0.3 g/l copper in the form of a water-soluble copper salt, to increase the speed of deposition. With a pH of 6.5 to 6.9 and a temperature of 96° to 99° C, the exposure time is 4 to 6 minutes, which corresponds to a nickel layer thickness of about 2 to 3 μm.

Subsequent to the electroplating with copper, any desired metals can be electrodeposited such as, for instance, nickel, chrome-nickel, tin or silver. It is of particular advantage that thermosetting plastic parts can be metallized exclusively without current, since any thickness of the nickel layer produced electrolessly frm the fast-depositing bath can be applied.

If hard chromium plating is applied subsequent to electroplating with nickel, it has been found advantageous to observe certain conditions of deposition. It is advantageous to keep the current density and the temperature constant within narrow limits in order to prevent the hard chromium layer from tearing open due to internal stresses. A particularly good hard chrome plate is obtained with a current density of 10 to 20 A/dm² and a temperature of 45° to 50° C.

Suitable thermosetting resins are phenolic resins, unsaturated polyester resins and epoxy resins.

According to the method of the invention, thermosetting plastic surfaces can be clad with an abrasion-proof, strongly adhering metal coating. In the specific case of the teleprinter type carrier, the latter is not only very light but also sufficiently abrasion- and wear-resistant. Another particularly advantageous application is, for instance, the metallizing of plastic parts of epoxy resin for satellite applications.

The invention will be explained in further detail by the following examples.

EXAMPLE 1

Articles of phenolic resin, e.g., teleprinter type carriers, are pre-etched at a temperature of 80° C for 4 to 6 minutes in a chromic-sulfuric acid solution. After rinsing in deionized and flowing water, decontamination in a ferrous sulfate-sulfuric acid solution containing 2 g/l $FeSO_4.7H_2O$ and 2 ml/l $H_2SO_4$ and again rinsing in flowing water, the phenolic resin parts are activated for 2 minutes in a stannous chloride solution of the following composition:

| | |
|---|---|
| Stannous chloride ($SnCl_2 . 2H_2O$) | 20 g/l |
| Concentrated hydrochloric acid (HCl) | 60 ml/l. |

After rinsing in flowing water, the articles are sensitized for 1 minute in a palladium chloride solution of the following composition:

| | |
|---|---|
| Palladium chloride ($PdCl_2$) | 0.2 g/l |
| Concentrated hydrochloric acid (HCl) | 3 ml/l. |

After rinsing in flowing water, they are immersed for 2 to 3 minutes at 90° C in an accelerator solution of the following composition:

| | |
|---|---|
| Sodium hypophosphite ($NaPH_2O_2 . H_2O$) | 70 g/l |
| Tri-sodium citrate ($C_6H_5Na_3O_7 . 5.5H_2O$) | 25 g/l |
| Ammonium chloride ($NH_4Cl$) | 25 g/l |
| 2,4-dihydroxybenzoic acid $(HO)_2C_6H_4COOH$ | 1 g/l |
| pH 7 (adjusted with ammonia) | |

The phenolic resin parts are then nickel-plated electrolessly, without rinsing, in a nickel bath of the following composition:

| | |
|---|---|
| Nickel sulfate ($NiSO_4 . 6H_2O$) | 35 g/l |

-continued

| | |
|---|---|
| Tri-sodium citrate ($C_6H_5Na_3O_7 . 5.5H_2$) | 100 g/l |
| Ammoniium Chloride ($NH_4Cl$) | 50 g/l |
| Sodium Hypophosphite ($NaPH_2O_2 . H_2O$) | 20 g/l |
| 2,4-dihydroxybenzoic acid $(HO)_2C_6H_4COOH$ | 2 g/l |
| Cupric Sulfate ($CuSO_4 . 5H_2O$) | 0.15 g/l |

at a pH of 6.5 to 6.9 for 4 to 6 minutes at a temperature of 96° to 99° C. After rinsing in water, pickling in 10% by vol. sulfuric acid and again rinsing, they are electroplated with copper at room temperature and a current density of 5 A/dm² for 15 minutes while air is being blown in. The parts which are copper-plated with a layer 20 μm thick are electroplated with nickel for 10 minutes, while air is being blown in, after pickling in 10% by vol. sulfuric acid and subsequent rinsing, with a current density of 5 A/dm² and a bath temperature of 50° C. The layer thickness is 15 μm. Subsequently, aftr rinsing in flowing water and pickling in 0.2% oxalic acid, they are electroplated with chromium with a current density of 14 A/dm² and a temperature of 47° C ± 1° C for 1 hour. A hard chromium layer 15 μm thick is obtained, which is distinguished by very high abrasion resistance.

EXAMPLE 2

Articles of unsaturated polyester resin are etched at a temperature of 80° C for 4 to 6 minutes in a chromic-sulfuric acid solution. After rinsing in deionized and flowing water and decontamination in a ferrous sulfate-sulfuric acid solution containing 2 g/l $FeSO_4.7H_2O$ in 2 ml/l concentrated $H_2SO_4$, they are rinsed once more in flowing water.

This is followed by activation for 2 minutes in stannous chloride solution of the following composition:

| | |
|---|---|
| Stannous chloride ($SnCl_2 . 2H_2O$) | 20 g/l |
| Concentrated hydrochloric acid (HCl) | 60 ml/l |

After rinsing in flowing water, they are sensitized for 1 minute in a palladium chloride solution of the following composition:

| | |
|---|---|
| Palladium chloride ($PdCl_2$) | 0.2 g/l |
| Concentrated hydrochloric acid (HCl) | 3 ml/l |

Rinsing in flowing water and immersion for 2 to 3 minutes follow in an accelerator solution of the following composition:

| | |
|---|---|
| Sodium hypophosphite ($NaPH_2O_2 . H_2O$) | 70 g/l |
| Trisodium citrate ($C_6H_5Na_3O_7 . 5.5H_2O$) | 25 g/l |
| Ammonium chloride ($NH_4Cl$) | 25 g/l |
| 2,4-dihydroxybenzoic acid $(HO)_2C_6H_4COOH$ | 1 g/l |

Thereupon, the polyester parts are nickel-plated electrolessly, without rinsing, in a fast-depositing nickel bath of the following composition:

| | |
|---|---|
| Nickel sulfate ($NiSO_4 . 6H_2O$) | 35 g/l |
| Tri-sodium citrate ($C_6H_5Na_3O_7 . 5.5H_2O$) | 100 g/l |
| Ammonium chloride ($NH_4Cl$) | 50 g/l |
| Sodium hypophosphite ($NaPH_2O_2 . H_2O$) | 20 g/l |
| 2,4-dihydroxybenzoic acid $(HO)_2C_6H_4COOH$ | 2 g/l |
| Cupric Sulfate ($CuSO_4 . 5H_2O$) | 0.15 g/l |

at a pH of 6.5 to 6.9 for 4 to 6 minutes at a bath temperature of 96° to 99° C. After rinsing in water, pickling in 10% by vol, sulfuric acid and again rinsing, they are electroplated with copper in an acid copper bath at room temperature with a current density of 5 A/dm² for 15 minutes, while air is being blown in. The parts, copper-plated with a layer 20 μm thick, are electroplated with tin, after pickling in 10% by vol. sulfuric acid and rinsing in flowing water, at a current density of 2 A/dm². After 12 minutes, the layer thickness is 12 μm. After they are dried, the parts tinned in this manner can be soft-soldered without difficulty.

What is claimed is:

1. A method for metallizing a thermosetting resin comprising:
   a. etching the surface of said resin with an oxidizing acid;
   b. activating the surface of said resin with a stannous chloride solution;
   c. sensitizing said resin in an aqueous solution of from 0.1 to 0.5 g per liter of palladium chloride and 1 to 6 ml of concentrated hydrochloric acid per liter;
   d. immersing said resin at about 90° C in an accelerator bath having a pH of about 7, said bath containing sodium hypophosphite, trisodium citrate, ammonium chloride and 2,4-dihydroxy benzoic acid;
   e. electrolessly nickel-plating said resin at a temperature of between about 96° to 99° C in a fast-depositing nickel bath having a pH of about 6.5 to 6.9 to form a nickel layer;
   f. electroplating said nickel layer with copper; and
   g. metallizing said copper layer to form a metallized layer.

2. The method of claim 1 which further comprises chrome-plating said metallized layer.

3. The method of claim 1 wherein said oxidizing acid is a chromic-sulfuric acid mixture.

4. The method of claim 3 wherein said etching is conducted for between about 4 and 5 minutes at a temperature of about 80° C.

5. The method of claim 1 wherein said stannous chloride solution comprises from about 20 g per liter of $SnCl_2.2H_2O$ and 60 ml of concentrated hydrochloric acid per liter.

6. The method of claim 1 wherein said resin is sensitized for about 0.5 to 3 minutes in a palladium chloride solution comprising about 0.2 g of palladium chloride per liter and about 3 ml of concentrated hydrochloric acid per liter.

7. The method of claim 1 wherein said resin is immersed in said acceleration bath for about 2 to 3 minutes, said bath containing about 70 g/l sodium hypophosphite about 25 g/l trisodium citrate, about 25 g/l ammonium chloride and about 1 g/l of 2,4-dihydroxy benzoic acid at a pH of about 7.

8. The method of claim 1 wherein said electroless nickel-plating step is carried out for about 4 to 6 minutes in a fast-depositing nickel bath comprising complex salts, sodium hypophosphite and about 0.1 to 5 g liter of a water-soluble polyhydroxy benzene.

9. The method of claim 8 wherein said nickel bath further comprises a water-soluble copper salt.

10. The method of claim 1 wherein said metallizing is carried out by electrodeposition.

11. The method of claim 10 wherein the metallized layer is electroplated with a metal selected from the group consisting of nickel, tin and silver.

12. The method of claim 2 wherein said chrome-plating is carried out at a current density of about 10 to 20 A/dm² and a temperature of about 45° C to 50° C.

13. The method of claim 12 wherein said current density is 15 A/dm² and said temperature is from 46° to 48° C.

14. The method of claim 1 wherein said resin is a phenolic resin.

* * * * *